219-121 SR
PFR48 XR 4,345,235

United States Patent [19]
Riley et al.

[11] 4,345,235
[45] Aug. 17, 1982

[54] VARIABLE RESISTANCE DEVICE HAVING A RESISTANCE ELEMENT WITH LASER CUTS

[75] Inventors: Richard E. Riley, Riverside; Bradley D. Turner, Covina, both of Calif.

[73] Assignee: Spectrol Electronics Corporation, City of Industry, Calif.

[21] Appl. No.: 187,251

[22] Filed: Sep. 12, 1980

[51] Int. Cl.[3] ..... H01C 10/38
[52] U.S. Cl. ..... 338/176; 29/620; 338/180; 338/195; 338/202
[58] Field of Search ..... 338/176, 180, 181, 183, 338/195, 202, 307–309, 171; 29/620

[56] References Cited

U.S. PATENT DOCUMENTS

| | | | |
|---|---|---|---|
| 3,379,567 | 4/1968 | Wright | 338/89 |
| 3,601,744 | 8/1971 | Zandman | 338/183 |
| 4,032,881 | 6/1977 | Singleton | 338/195 |
| 4,051,453 | 9/1977 | Barden | 338/171 |
| 4,150,366 | 4/1979 | Price | 338/195 X |
| 4,159,461 | 6/1979 | Kost et al. | 338/195 |
| 4,197,521 | 4/1980 | Rovynyak | 338/195 |
| 4,205,296 | 5/1980 | Frey, Jr. | 338/171 X |
| 4,243,969 | 1/1981 | Steigerwald | 338/176 X |
| 4,274,074 | 6/1981 | Sakamoto | 338/171 |

OTHER PUBLICATIONS

An Introduction to Laser Trimming, "Laser Trim System—An Overview", Chicago Laser Systems, Inc., Approx. 8/79.
Pertinent Pages of Chicago Laser Systems, Inc., Sales Brochure entitled "An Introduction to Laser Trimming".

*Primary Examiner*—C. L. Albritton
*Attorney, Agent, or Firm*—J. Raymond Curtin; David L. Adour

[57] ABSTRACT

An electrical resistance element for a variable resistance device, such as a thick film resistance element, and a method of making the element and a device utilizing the element, such as a potentiometer, is described. The resistance element comprises a single resistance material for use as a resistance path for a contact wiper in a variable resistance device and has a selected series of generally transverse cuts made in at least one section of the resistance material of the element. The cut section(s) provides an increased current path length through the element whereby the total resistance of the element is increased. Also, the cut section(s) provides the resistance element with a resistance function which can be adjusted to vary over a wide range of resistance values depending on the length, width, and number of the cuts.

2 Claims, 5 Drawing Figures

VARIABLE RESISTANCE DEVICE HAVING A RESISTANCE ELEMENT WITH LASER CUTS

BACKGROUND OF THE INVENTION

1. Field of the Invention

This invention relates to variable resistance devices such as a potentiometer. Specifically, this invention relates to an electrical resistance element of a variable resistance device and the method of making such a resistance element whereby the resistance function of the element is designed to provide a selected non-linear resistance. More specifically, this invention relates to a potentiometer having a thick film electrical resistance element with at least one section of the element having a selected series of alternating, generally transverse cuts which may be made by a laser.

2. Description of the Prior Art

Resistance elements are known which provide non-linear electrical resistance functions. Also, it is known to use these elements as part of a variable resistance device.

There are generally two methods of making non-linear resistance elements which are pertinent in regard to the present invention. The first method requires using two or more materials to construct the resistance path of the element. Two materials are either placed sequentially along the resistance path or one material is placed alongside the resistance path in electrical contact therewith. Both methods require multiple printing of the resistance material onto the non-conducting substrate of the element. Multiple printing and firing of the resistance material in the manufacturing process is expensive and time consuming since each material must be printed and heat treated separately thereby doubling or tripling the handling of each element. In addition, the rejection or fracture rate increases with each handling, printing and firing of the element. The second method requires physical tailoring or cutting away of the conductive path, that is, making a longitudinal cut in the material to give a selected resistance function. This method requires the predetermination of the shape and path to be cut and elaborate controls to guide and regulate the longitudinal cut. The tailored shape is not easily adjusted to compensate for irregularities and differences in the resistance material from element to element.

Resistance elements of a variety of constructions are known for use in fixed resistance devices. The most pertinent known element in regard to the present invention includes a thick film resistance element having transverse cuts made in the resistance material by a laser beam. The cuts increase the current path length through the material thereby increasing the total resistance of the element. The increase in path length is a function of the length, width and location of the cuts. This type of resistance element is used to make fixed resistance devices and to the best of our knowledge has not heretofore been used in variable resistance devices.

SUMMARY OF THE INVENTION

The present invention relates to variable resistance devices, such as a potentiometer, to a resistance element for use in such devices and to the method of making such a resistance element. The resistance element is designed to be used with a multi-fingered contact wiper. The element is composed of a single resistance material having a selected series of transverse cuts in at least one section of the resistance material to provide a desired resistance function for the element. The cuts are made by a laser beam, with the length, width and location of the cuts controlled to give the resistance element a desired resistance function. Resistance elements and variable resistance devices constructed according to the principles of the present invention nearly eliminate noise spikes and are extremely easy to design to approximate desired resistance functions (even if the desired functions vary over a wide range of resistance values). They have excellent heat dissipation characteristics, and are easily and rapidly mass produced since only one resistance material is used in their manufacture.

It is the above object of the present invention to provide an electrical resistance element for use in variable resistance devices and to provide a method of making such an element whereby a desired non-linear resistance function is approximated by the element.

It is a further object of the present invention to provide an improved variable resistance device, such as a potentiometer.

These and other objects of the present invention are attained by making a selected series of alternating, generally transverse cuts in at least one section of the single resistance material of a resistance element. The length, width and locations of the cuts are designed to give the element a selected resistance function. The cuts may be made by a computer controlled laser beam and the element may be used in variable resistance devices such as a potentiometer.

DESCRIPTION OF THE PREFERRED EMBODIMENTS

Figure 1:
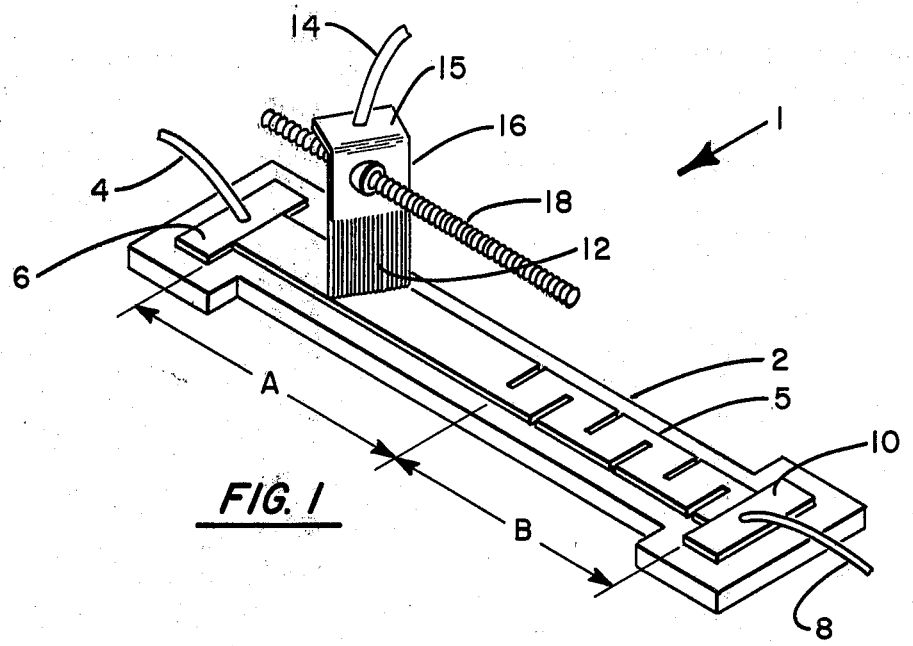
FIG. 1 is an isometric view of a straight potentiometer constructed according to the principles of the present invention.

Referring now to FIG. 1, a potentiometer 1 is shown embodying the concepts of the present invention. An electrically non-conductive base 2, usually made of a ceramic material or any other such suitable non-conducting material, is used as a support member for an electrical resistance material (conductive material) 5, usually a thick film cermet material, conductive plastic, or other like material. The resistance material 5 with its non-conductive base 2 form a resistance element. Electrical leads 4 and 8 are attached to contacts 6 and 10 which are in contact with the resistance material 5. A multifingered contact wiper 15, consisting of a series of fingers or contacts 12, block 16 and electrical connector 14, is in contact with the electrically conductive material 5 and is attached to a housing (not shown) for the potentiometer 1 through a threaded driveshaft 18. The drive shaft 18 allows the multi-fingered contact wiper 15 to be moved along with and in contact with the resistance material 5. The fingers 12 may be positioned at an angle relative to or perpendicular to the travel path across the resistance material 5.

Figure 4:
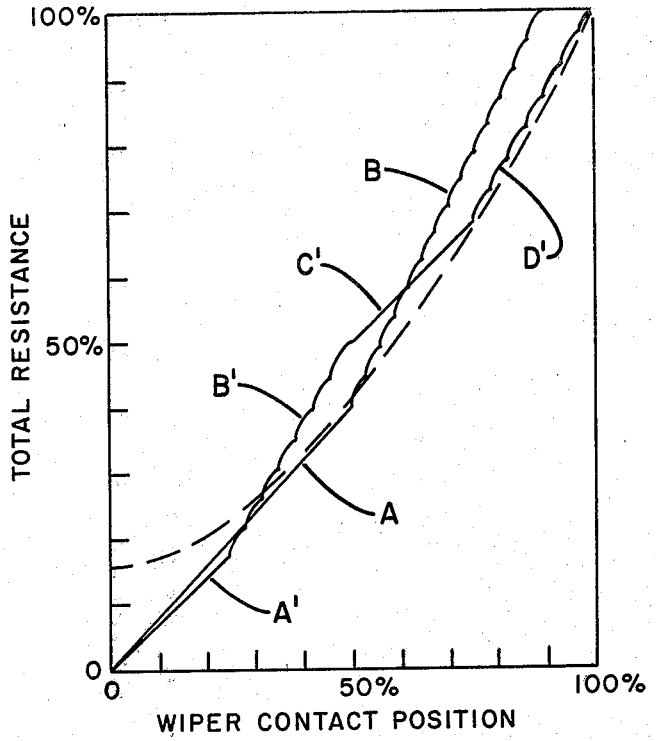
FIG. 4 shows a sketch of the resistance functions of the resistance elements shown in FIGS. 1 and 3 as a function of the contact wiper position on the resistance element.

As shown in FIG. 1, the resistance material 5 is comprised of two sections A and B. Section A is solid resistance material. Section B is composed of the same material as section A but has a selected series of alternating, generally transverse cuts. The solid resistance material section and cut section are designed to give the resistance element a desired resistance function. This means that as the wiper 15 moves along the resistance material 5 the resistance values between electrical leads 4 and 14 and 8 and 14 will vary, as depicted in FIG. 4, to approximate a desired resistance function. Section A, as depicted in FIG. 4, will yield a corresponding resistance function segment having a moderate, constant slope. Section B, also depicted in FIG. 4, will yield a corresponding resistance function segment having a greater slope with small ripples. The ripples correspond to the multi-fingered contact wiper 15 transversing cuts.

Figure 2:
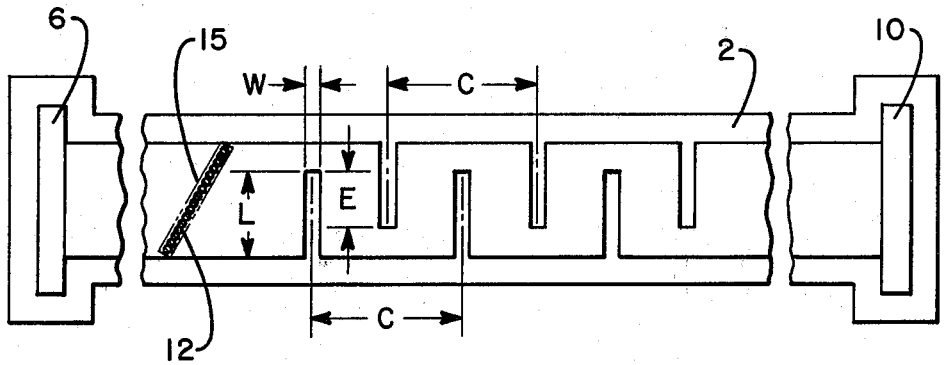
FIG. 2 is an enlarged view of the cut section of the resistance element of the potentiometer shown in FIG. 1.

FIG. 2 shows an enlarged view of the cut section of the potentiometer 1 shown in FIG. 1. As shown in FIG. 2, the cuts are generally transverse and alternate from one side of the resistance material 5 to the other. The cuts are made with a selected fixed period. This means that there is a fixed distance C between cuts on the same side of the resistance material 5. The cuts may or may not overlap by a distance designated as E in FIG. 2. The length L and width W of the cuts determine the current path length for the resistance material 5 and alters the number of "squares" of resistance material 5. "Squares" are a convenient concept for calculating the total resistance of a thick film resistor. The total thick film resistance value may be defined as:

$$R=\rho(l/A)$$

where $\rho$ is the resistivity of the resistance material, l is the resistor length and A is the resistor cross-sectional area. For a resistor having a constant fixed depth, the equation may be rewritten to define R in terms of sheet resistivity as $$R=R'n$$

where n is defined as the number of squares and R' is the sheet resistivity per unit area or per square at a constant thickness (usually 1 mil for most thick film resistors).

Thus, it is clear that as the width or length of a cut in the resistance material increases the total resistance of the resistor will increase.

The cuts used in the present invention are generally transverse, small-width (on the order of 1 to 2 mil) alternating cuts and are not a continuous longitudinal cut. Although the preferred method is to use a series of alternating cuts this is not critical. A single cut of suitable length or cuts made from only one side of the resistance material may be feasible or even desirable depending on the particular resistance function being approximated. Also shown in FIG. 2 are electrical contacts 4 and 10 and wiper 15 with contact fingers 12. These are shown to better show the relation of the enlarged section shown in FIG. 2 to the potentiometer 1 shown in FIG. 1.

Figure 3:
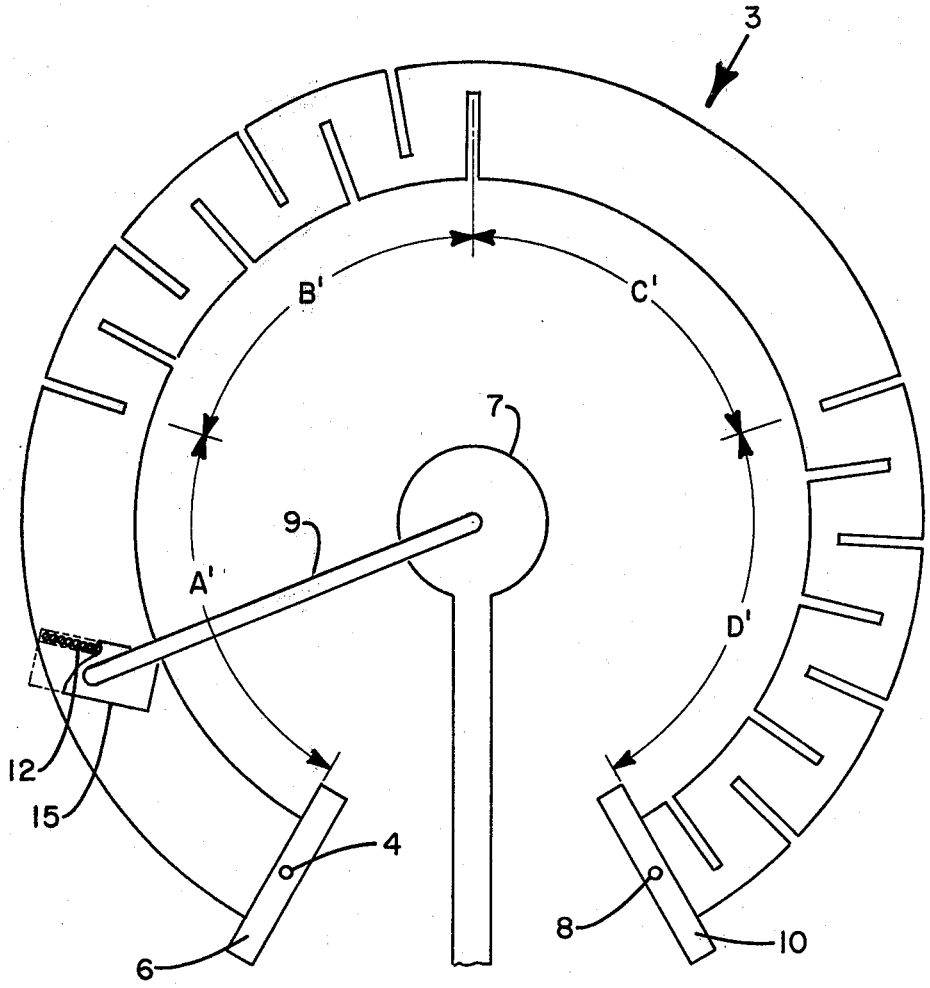
FIG. 3 is a schematic view of a curved resistance element having two cut sections constructed according to the principles of the present invention.

FIG. 3 shows a curved resistance element 3 having two cut sections interspersed with two solid sections. Electrical contacts 6 and 10 with leads 4 and 8 and wiper 15 with contact fingers 12 and electrical connector 9 aid in showing the position of the electrical resistance element 3 when used in a variable resistance device such as a potentiometer. Electrical connector 9 is illustrated to show a preferred method of connecting the contact wiper 15 to an electrical contact 7. For purposes of explanation, the cut sections in the resistance element 3 are made of equal length and the period of the cuts in each section is chosen to be the same. However, in constructing an electrical resistance element according to the principles of the present invention variations in the location of the cut sections and the period of the cuts in each section may vary.

FIG. 4 shows a sketch of the resistance function of the resistance element 3 shown in FIG. 3 and the resistance element of the potentiometer 1 shown in FIG. 1 as a function of contact wiper position when the elements are used as part of a variable resistance device. As shown in FIG. 4, the resistance element 3 is designed to yield a non-linear resistance function which closely approximates a particular resistance function, for example, a function of a parabolic shape. Portions A', B', C' and D' shown along the solid line in FIG. 4 correspond to the sections A', B', C' and D' of the resistance element as designated in FIG. 3. As shown by the solid line drawn in FIG. 4, the slope of the resistance function corresponding to the solid sections of the resistance element 3, designated A' and C', are moderate and constant. However, in the cut sections of the resistance element 3, designated as B' and D', the resistance function has an increased slope. In addition, small ripples can be seen in the resistance function. These ripples result from the multi-fingered contact wiper 15 traversing cuts. The large number of wiper contacts and the angling of the wiper 15 relative to the path of travel of the wiper along the resistance element 3 result in a relatively insignificant ripple effect. The important aspect to note is the dramatic increase in the slope of the resistance function when the wiper 15 is traveling through the cut sections. This allows variable resistance devices to be constructed having resistance functions varying over a wide range of electrical resistance values. This feature is achieved while using a single resistance material and while maintaining the integrity of the resistance material used in the resistance element which results in better heat dissipation and ease of manufacture.

The resistance element 3, shown in FIG. 3, could have any number of cut sections limited only by the physical dimensions of the resistance element 3 and the necessity for a certain number of cuts to achieve a desired resistance value. Within these limitations the resistance function of the resistance element 3 can be altered to approximate any desired resistance function.

Figure 5:
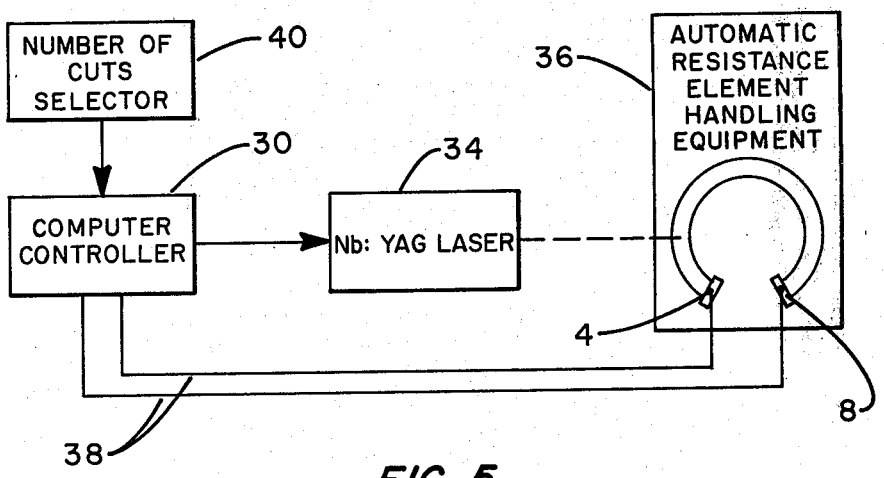
FIG. 5 is a block diagram depicting a computer controlled laser beam system for making the cut sections in a resistance element constructed according to the principles of the present invention.

FIG. 5 is a block diagram showing a method by which the cuts may be made in a resistance element such as resistance element 3 shown in FIG. 3 or in the resistance element of the potentiometer shown in FIG. 1. As shown in FIG. 5, a computer controlled Nd: YAG laser 34, such as Chicago Laser Systems Model CLS-33 Laser Resistor Trimming System, is used to cut the resistance element. The total resistance is measured and monitored through electrical leads 38 connected to contacts 6 and 8 of the resistance element. This total resistance value is used by the control system in conjunction with a preselected number of cuts, generally indicated by block 40 in FIG. 5, to provide the necessary inputs to the computer control system 30. The control system automatically makes the cuts at the lengths necessary to give the resistance element the desired resistance function necessary to accurately approximate a desired resistance function. Automatic resistance element handling equipment 36 positions the element in the proper position for making the cuts. The length of the cuts is varied to account for inhomogeneities in the resistance material, and other such variables which cannot be adequately controlled when making the resistance element.

In a preferred method of constructing a resistance element and variable resistance device according to the principles of the present invention a physical configuration for the element and device is chosen. For example, a curved element as shown in FIG. 3 or a straight element as shown in FIG. 1 may be chosen. Then the resistance element is made by depositing a resistance (conductive) material on a non-conductive substrate through a deposition process such as silk screening. The resistance material may be a cermet material or conductive plastic material as mentioned previously. The resistance element is then cut in an automatic process such as by using the laser resistor trimming system described in conjunction with FIG. 5. This process comprises selecting a number of cuts to be made in selected sections of the resistance material. The number and location of the cuts are selected, based on prior experience and resistance calculations, to generally give the resistance element a desired resistance function. The cuts are then made while continuously monitoring the total resistance of the element. The cuts are preferably all of the same width (on the order of 1 or 2 mil) and completely cut through the entire depth of the resistance material. Also, preferably, the cuts are made from alternate sides of the resistance material and are generally transverse to the conductive path. However, the cuts need not be of the same width, nor alternate, nor be generally transverse. The particular resistance function being approximated determines the best configurations for the cuts. The length of the cuts is determined in response to the measured total resistance to adjust the resistance function of the element being cut to correspond to a desired function. The lengths may need to vary depending on such factors as resistance material inhomogenity.

Once the resistance element has been cut the resistance element is placed in a housing and a contact wiper and electrical contacts are put in place to form a variable resistance device, for example, a potentiometer. As the contact wiper is moved along the resistance element the resistance will vary as preselected and determined by the configuration of the solid and cut sections.

While the present invention has been described in connection with particular embodiments, it is to be understood that various modifications may be made without departing from the scope of the invention heretofore described and claimed in the appended claims.

We claim:

1. A variable resistance device comprising:

an electrically non-conducting substrate;

a layer of resistance material on the surface of the substrate forming a resistance path, said resistance material having at least one series of overlapping laser cuts in the edges of the resistance material generally transverse to the resistance path, said cuts being relatively small in width compared to the dimensions of the resistance path with each successive cut being in the edge opposite to the preceeding cut and with the length of each cut and the spacing between cuts selected to provide a desired non-linear resistance function along the resistance path;

a multi-fingered contact wiper which may move along and in contact with the resistance path to provide different resistance values when the wiper is in contact with different sections of the resistance path, said wiper oriented at an angle to the cuts in the resistance path so that deviations from the desired non-linear resistance function, due to the wiper crossing the cuts in the resistance path, are substantially eliminated;

a first electrical contact connected to the resistance material at one end of the resistance path; and a second electrical contact connected to the resistance material at the end of the resistance path opposite to the end of the resistance path at which the first electrical contact is connected.

2. A method of making a variable resistance device which comprises:

depositing a layer of resistance material on the surface of an electrically non-conducting substrate to form a resistance path for a multi-fingered contact wiper;

connecting a first electrical contact to the resistance material at one end of the resistance path;

connecting a second electrical contact to the resistance material at the end of the resistance path opposite to the end of the resistance path at which the first electrical contact is connected;

cutting, with a computer controlled laser system, at least one series of overlapping cuts in the edges of the resistance material generally transverse to the resistance path, said cuts having relatively small widths compared to the dimensions of the resistance path and with each successive cut made in the edge opposite to the preceeding cut;

monitoring the total resistance along the resistance path between the first and second electrical contacts as the cuts are made;

controlling the length of each laser cut and the spacing between cuts to provide a desired non-linear resistance function along the resistance path; and positioning a multi-fingered contact wiper in contact with and at an angle to the cuts in the resistance path whereby the wiper may move along the resistance path to provide different resistance values when the wiper is in contact with different sections of the resistance path and whereby deviations from the desired non-linear resistance function, due to the wiper crossing the cuts in the resistance path, are substantially eliminated.

* * * * *